United States Patent [19]

Plessis et al.

[11] Patent Number: 4,675,891

[45] Date of Patent: Jun. 23, 1987

[54] X-RAY APPARATUS WITH FOCUS POSITION CONTROL

[75] Inventors: André Plessis, Issy Les Moulineaux; Jacques Leguen, Paris, both of France

[73] Assignee: Thomson-CGR, Paris, France

[21] Appl. No.: 748,382

[22] Filed: Jun. 25, 1985

[30] Foreign Application Priority Data

Jun. 29, 1984 [FR] France ..... 84 10356

[51] Int. Cl.[4] ..... H01J 35/26

[52] U.S. Cl. ..... 378/132; 378/125; 378/126; 378/135; 378/204; 378/207

[58] Field of Search ..... 378/10, 12, 126, 132, 378/135, 145, 150–151, 204–207, 93, 94, 125

[56] References Cited

U.S. PATENT DOCUMENTS 3,836,805 9/1974 Kok ..... 378/93
4,160,909 7/1979 Froggatt ..... 378/12
4,162,420 7/1979 Grady ..... 378/126
4,464,778 8/1984 Goldman ..... 378/150

FOREIGN PATENT DOCUMENTS 0060950 4/1984 Japan ..... 378/125
0446005 10/1974 U.S.S.R. ..... 378/207

*Primary Examiner*—Craig E. Church
*Assistant Examiner*—John C. Freeman
*Attorney, Agent, or Firm*—Pollock, VandeSande & Priddy

[57] ABSTRACT

The invention relates to an X-ray apparatus with focus position control, the focus being formed on the anode of an X-ray tube with magnetic bearings. The X-ray apparatus comprises a focus position sensing device cooperating with electronic means associated with the magnetic bearings, in order to control the position of the focus by displacing a rotor under the action of the magnetic bearings.

12 Claims, 3 Drawing Figures

X-RAY APPARATUS WITH FOCUS POSITION CONTROL

BACKGROUND OF THE INVENTION

The present invention relates to an X-ray apparatus with focus position control formed on the rotary anode of an X-ray tube with magnetic bearing. The invention is applicable in general terms to X-ray diagnosis and particularly in X-ray scanning.

In X-ray diagnosis, the X-ray used is generally produced from an X-ray tube carrying a generally rotary anode, on which the impact of an electron beam defines a focus, which constitutes the X-ray source.

The X-ray tube is installed in a protective sheath (against high voltage and X-ray), with which it constitutes an X-ray emitter means. When the latter is mounted on an X-ray apparatus, it is only the actual sheath which is fixed thereto on supports of reference surfaces provided for this purpose. If it is wished to easily ensure the rigidity of this fixture, relative movements between the focus of the X-ray tube and the mechanical references of the sheath containing the same are difficult to control.

These movements mainly have two origins. The first origin is of a mechanical nature. The fixing parts connecting the X-ray tube in its sheath are necessarily formed from electrically insulating material. Certain of these materials are not rigid and are not in fact mechanical materials, said insulants having an excessive flexibility and compressibility. The second origin is due to thermal movements. During the normal use of an X-ray assembly, the temperature differences to which it is exposed are considerable, particularly for certain elements of the X-ray tube such as the anode disk, the different spindles and the rotor to which the anode is coupled in rotation.

Thus, between a cold start and balanced temperature operation, by no means negligible expansions (0.5 mm) occur, which lead to the displacement of the focus with respect to an initial position thereof at cold start. This displacement of the focus due to the thermal movement mainly takes place in an axis parallel to that along which the anode disk is connected to the rotor.

The inevitable thermal movements of the focus are prejudicial to the operation of X-ray equipment particularly in X-ray scanning where the image quality is limited by acquisition defects with respect to the analog signals, particularly due to deviations relative to the spatial position of the focus.

SUMMARY OF THE INVENTION

The object of the present invention is to permit an improvement to the quality of X-ray imaging by stabilizing the position of the focus in space along a longitudinal axis of the X-ray tube.

For this purpose, the present invention uses an X-ray tube of the type having magnetic bearings, by modifying the organization of the conventional means associated with said bearings, by which the rotor is made to occupy an equilibrium position between the radial axes and a longitudinal axis. It is known that magnetic bearings comprise a system of stators, each stator being itself formed from a certain number of independent magnetic poles and whereof the harmony of actions, managed by control electronics, makes the position of the rotor stable in space. For this purpose, the control electronics must receive information from the rotor position detectors at all times, so that if necessary, it is possible to correct a rotor position fault by acting on one or more magnetic poles. It is mathematically known that a rotor (likenable to a cylinder) has five degrees of freedom in a three-dimensional space and for magnetic bearings it is appropriate to define five axes. These axes are subdivided into one longitudinal axis and four radial axes contained in the planes of two different cross-sections. Two radial axes of the same section are generally orthogonal and parallel, each to one of the radial axes of the other section. Thus, it is sufficient to place at least one position detector on each of these axes to obtain complete information on the spatial position of the rotor. It is necessary and is also adequate that for each position fault indicated by a position detector, an action is possible along the axis corresponding to said position detector by the attraction of a pole or a combination of poles. In addition, the magnetic bearings are generally organized as radial bearings, axial bearings or conical bearings. The radial and conical bearings generally have four poles (two poles on each controlled axis) and the axial bearings one or two poles. The radial and axial bearings only act along a single axis, while the conical bearings act both along a radial axis and along a longitudinal axis. Thus, the two best known magnetic bearing systems are formed as follows: for the first system two radial bearings (each with four poles controlling two axes) and an axial bearing, and for the second system two conical bearings with four poles. Each system has at least one position detector along the five axes of the five degrees of freedom referred to hereinbefore.

In the X-ray apparatus according to the invention, use is made of the action of the magnetic bearings on the rotor, along a longitudinal axis, as a result of a novel arrangement making it possible to control the rotor position as a function of a desired focus position.

The present invention specifically relates to an X-ray apparatus with focus position control, comprising an X-ray tube with a rotary anode on which said focus is formed, said X-ray tube being of the type with magnetic bearings and having a rotor coupled in rotation with said rotary anode along a longitudinal axis about which it brings about the rotation of said anode, said magnetic bearings being controlled by electronic means, said rotor being able to move along the said longitudinal axis under the action of said magnetic bearings, wherein it also comprises a device for sensing the position of the focus supplying a signal which varies as a function of a position variation of the focus along a control axis parallel to the longitudinal axis and wherein the signal is applied to electronic means so as to control, via said magnetic bearings, a displacement of the rotor along the longitudinal axis in a direction opposite to that of the focus.

BRIEF DESCRIPTION OF THE DRAWINGS

The invention is described in greater detail hereinafter relative to a non-limitative embodiment and the attached drawings, wherein.

For reasons of clarity, the same elements carry the same references in the three figures.

DETAILED DESCRIPTION OF THE INVENTION

Figure 1:
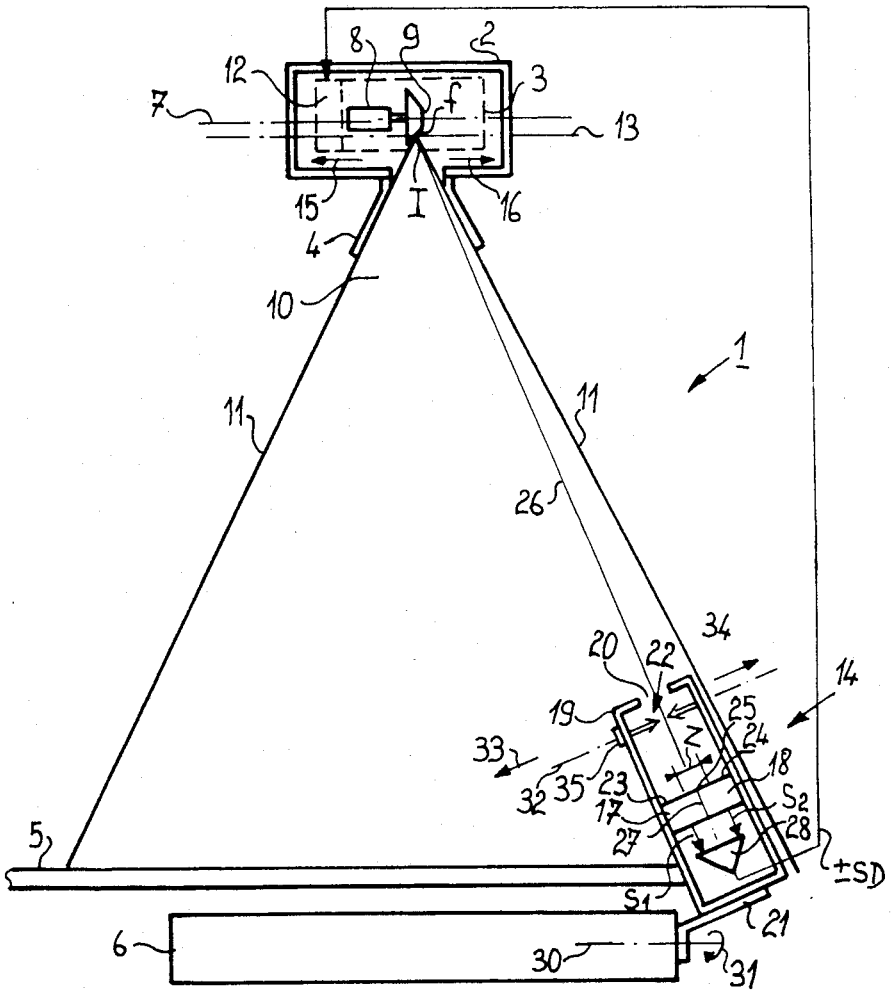
FIG. 1 diagrammatically shows the general structure of an X-ray apparatus according to the invention.

FIG. 1 diagrammatically shows the general structure of an X-ray apparatus 1 according to the invention, whereof the representation is limited to the means necessary for the understanding of the invention.

The X-ray apparatus 1 comprises a sheath 2 containing an X-ray tube 3 (partly represented in a dotted line frame) of the type having magnetic bearings (not shown in FIG. 1). The sheath 2 is assembled with a beam limiting device 4 and is supported in a conventional, not shown manner above a partly shown table top 5, beneath which is also arranged in a conventional manner an X-ray receiving means 6.

The X-ray tube 3 has a longitudinal axis 7, along which is arranged a rotor 8 integral with a rotary anode 9. The X-ray tube 3 produces, from a focus f formed on anode 9, an X-ray beam 10, whose limits 11 are defined by the limiting device 4.

As will be explained in greater detail hereinafter relative to FIG. 2, rotor 8 is able to move along the longitudinal axis 7, under the action of magnetic bearings (not shown in FIG. 1), which are themselves controlled by electronic means 12 associated with said magnetic bearings.

This possibility of the displacement of rotor 8 is used in the X-ray apparatus 1 according to the invention for controlling the position of focus f along a control axis 13 parallel to the longitudinal axis 7. The displacement of rotor 8 takes place as a function of an observed displacement of focus f along same control axis 13.

For this purpose, the X-ray apparatus 1 according to the invention also comprises a device 14 for sensing the position of the focus and which is able to supply a signal ±SD indicating that the focus f moves along the control axis 13, in one or other of the opposite directions shown by the first and second arrows 15, 16.

Focus position sensing device 14 can comprise detector means 17, 18, which are sensitive to X-rays and on which is produced a not shown image of focus f.

In the non-limitative embodiment described, the focus position sensing device 14 has a support structure 19, provided with an opening 20 oriented towards the focus f. Sensing device 14 is joined by fixing means 21 to receiver means 6, the later constituting in the present embodiment a reference member relative to which it is wished to control the position of foucs f. The sensing device 14 comprises a pinhole camera 22, by which the image of the focus f is formed on input planes 23, 24 of detector means 17, 18. (The term pinhole camera is understood to mean all means having an opening or aperture, such as a slit, making it possible to produce the image of a focus).

In the present non-limitative embodiment, the two detector means 17, 18 are arranged contiguously and are separated by a thin partition 27, which is projected onto the input planes 23, 24 along a median line which, as it is positioned along a plane perpendicular to FIG. 1, coincides with a central point 25, which constitutes the center of a zone Z, on which the image of focus f is formed by a pinhole camera 22, so as to be equally distributed over each of the two input planes 23, 24. The central point 25 or median line and pinhole camera 22 define a reference axis 26, which only has to be oriented so that it passes through focus f in order to obtain said equal distribution of the image of focus f on the two input planes 23, 24. Each detector means 17, 18 supplies an output signal $S_1$, $S_2$, which varies as a function of the illumination of its input plane 23, 24 by the image of focus f. In addition, as in the present embodiment, the two detector means 17, 18 have similar characteristics, the respective output signals $S_1$, $S_2$ supplied by each of them have the same amplitude when the image of focus f is equally distributed over each input plane 23, 24.

In this configuration, the comparison of the output signals $S_1$,$S_2$ supplies an information indicating whether the image of focus f is equally distributed or not over each of the input planes 23, 24, i.e. whether the reference axis 26 does or does not pass through focus f. As a function of the sense of their difference, the comparison between the output signals $S_1$,$S_2$ also gives information on the direction 15, 16 in which focus f has moved along control axis 13, with respect to a point I where the reference axis 26 intersects the control axis 13.

In the non-limitative embodiment described, the means used for comparing the output signals $S_1$,$S_2$ is constituted by a differential amplifier 28, to which these output signals $S_1$, $S_2$ are applied. The differential amplifier 28 supplies a difference signal ±SD, expressed by a voltage, whose value is equal to zero when the reference axis 26 passes through focus f and whereof the value differs from zero in the opposite case. The polarity of difference signal ±SD is positive or negative, depending on whether focus f has moved in the first or second direction 15, 16 relative to the intersection point I.

The X-ray apparatus 1 according to the invention mades it possible to control the position of focus f relative to the intersection point I considered as the initial position of the focus f.

To this end, the difference signal ±SD, supplied by the focus position sensing device 14 is applied to electronic means 12, which conventionally serves to manage the operation of the magnetic bearings.

The sensing device 14 is positioned in such a way that the reference axis 26 passes through focus f said condition being proved by measuring with conventional not shown means the difference signal ±SD, which in this case has a value equal to zero.

The positioning of reference axis 26 can be obtained at the fixing means 21, e.g. by bringing about a rotation of the latter about a fixing axis 30, in accordance with the third arrow 31, and by moving pinhole camera 22 along a second axis 32. Pinhole camera 22 can be moved in one or other of the directions indicated by the fourth and fifth arrows 33, 34 by conventional displacement means 35, via which pinhole camera 22 is joined to the support structure 19.

It should be noted that the focus position sensing device 14 is located on the periphery of the X-ray beam 10 in the vicinity of a limit 11 of the latter, so as to permit the normal operation of the X-ray apparatus 1 in X-ray diagnosis.

Figure 2:
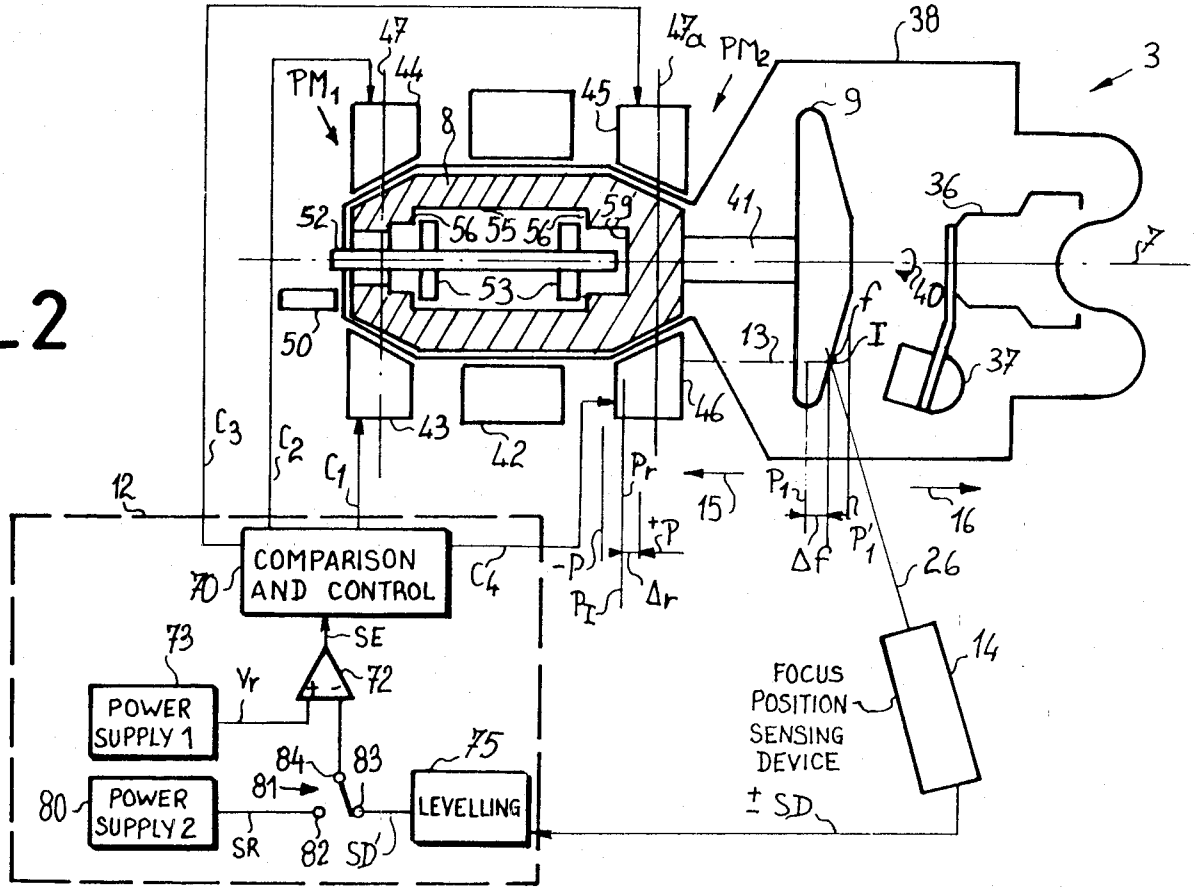
FIG. 2 is a diagram showing an organization of means associated with magnetic bearings of an X-ray tube in a preferred embodiment of the X-ray apparatus according to the invention.

FIG. 2 is a diagram showing, in a preferred embodiment of the X-ray apparatus 1 according to the invention, the way in which the focus position sensing device 14 is associated with the magnetic bearings via electronic means 12.

In known manner, the X-ray tube 3 has in an envelope 38, a cathode 37 which is kept facing anode 9 by a support 36. In operation, the rotary anode 9 is rotated about longitudinal axis 7, in the direction indicated by, e.g. a sixth arrow 40 and has the focus f formed from cathode 37. Rotary anode 9 is joined by a shaft 41 to rotor 8, which ensures the rotation thereof by a stator 42.

In the non-limitative embodiment shown, rotor 8 is supported during its rotation by magnetic bearings of the type having a first and a second conical bearing $PM_1$, $PM_2$ located on the same side with respect to the rotary anode 9.

As explained hereinbefore, each of the bearings has in per se known manner four magnetic poles arranged in pairs along radial axes. In FIG. 2, the first and second bearings $PM_1$, $PM_2$ are in each case represented solely by two poles arranged along a first and a second radial axis 47, 47*a* contained in the same plane as that of the drawing. Thus, for the first bearing $PM_1$, there is a first and second magnetic pole 43, 44 respectively, positioned on either side of rotor 8 along the first radial axis 47, while for the second bearing $PM_2$ there is a third and fourth magnetic pole 45, 46 respectively, positioned along the second radial axis 47*a*. The two other magnetic poles each having bearings $PM_1$, $PM_2$ are not shown for reasons of clarity, because they are positioned along not shown radial axes, perpendicular to the plane of FIG. 2.

In the non-limitative embodiment described, rotor 8 is hollow and rotates about a fixed shaft 52, provided with two guard bearings 53 on which rotor 8 bears when it is not kept in equilibrium. A not shown distance between an inner longitudinal wall 55 of rotor 8 and the bearings 53 represents a space in which rotor 8 can move along radial axes 47, 47*a*. Rotor 8 can also move along longitudinal axis 7 between inner shoulders 56 equipping rotor 8 and on which bear the guard bearings 53 when rotor 8 is moved in the directions indicated by the first and second arrows 15, 16.

Thus, in conventional manner, along radial axes 47, 47*a*, the equilibrium of rotor 8 is obtained by an action of the first and fourth magnetic poles 43, 46, which simultaneously oppose the second and third magnetic poles 44, 45. The equilibrium of rotor 8 along longitudinal axis 7 is obtained by the action of the first and second magnetic poles 43, 44, which oppose the action of the third and fourth magnetic poles 45, 46. Magnetic poles 43 to 46 act under the control of electronic means 12.

To this end, the electronic means 12 comprise, in per se known manner, comparison and control means 70, which supply a control signal to each magnetic pole having a bearing. In the non-limitative embodiment described, the magnetic poles arranged along radial axes perpendicular to the plane of FIG. 2 are not shown, the representation of these controls being limited to four controls $C_1$, $C_2$, $C_3$, $C_4$ applied respectively to the first, second, third and fourth magnetic poles 43, 44, 45, 46.

The control signals $C_1$ to $C_4$ are generated as a function on the one hand of signals produced by radial position detectors (not shown) provided in conventional manner on bearings $PM_1$, $PM_2$ and on the other as a function of axial position signals not shown in FIG. 2, relative to the position of rotor 8 along the longitudinal axis 7 and supplied by an axial position detector 50. The combinations of these different means constitute per se known control loops.

In the operation according to the prior art, the rotor 8 is kept permanently at a so-called reference position $P_r$, which is e.g. that indicated in FIG. 2 by a broken line system coinciding with the plane of a lateral inner wall 59 of rotor 8. As stated hereinbefore, rotor 8 is displaceable along longitudinal axis 7 on either side of the reference position $P_r$, within the limits $-P$, $+P$ imposed by shoulders 56. The reference position $P_r$ is generally regulated by a voltage level, which constitutes a reference voltage $V_r$ with which is compared an axial position signal (not shown in FIG. 2) supplied by the axial detector 50. This comparison makes it possible to produce an error signal SE, on the basis of which, via comparison and control means 70, the magnetic poles 43 to 46 are controlled so as to bring about a displacement of rotor 8 in the appropriate direction 15, 16 for replacing the latter in the reference position $P_r$.

As in the prior art, the electronic means 12 comprise a comparator means 72 to which, in this first version of the invention, is applied to a first positive input a reference voltage $V_r$ supplied by a power source 73.

However, in the X-ray apparatus 1 according to the invention, an important difference compared with the prior art is that the focus position sensing device 14 participates in producing the error signal SE applied to the comparison and control means 70.

It is pointed out that the previously described focus position sensing device 14 has an output voltage corresponding to the first difference signal $\pm SD$, which is dependent on the X-ray quantity supplied by the X-ray tube 3, except in the case where the focus f is perfectly centered on reference axis 26. In this case and as explained hereinbefore, said voltage has a zero value and this is retained even with X-ray quantity variations. The invention can be used in an optimum manner if the sensing device 14 is of the type described.

It is also pointed out that the main function of the levelling means 75 is to adapt the level of the first difference signal $\pm SD$ to the requisite level, i.e. to the level of the signal produced by axial detector 50. This levelling means could be eliminated and the difference signal $\pm SD$ could be directly applied to the comparator means 72, particularly if the focus position sensing device 14 is of the aforementioned type and in this case the reference voltage $V_r$ must also be zero.

In a preferred embodiment of the invention shown in FIG. 2, the difference signal $\pm SD$ is applied to a levelling means 75 having, e.g. a not shown amplifier, which supplies a second difference SD′ applied to the second negative input of comparator means 72. Signal SD′ then has a value similar to the signal which could be supplied by the axial position detector means 50 (not used), when the rotor 8 occupies a reference position PR along a longitudinal axis 7.

In the non-limitative embodiment described, the second difference signal SD′ is applied to the comparator means 72, via a manual or automatic switching means 81, whose function will be explained hereinafter.

In this configuration, the second difference signal SD′ has an initial value representing a position of the focus f in which, as stated hereinbefore, the reference axis 26 passes through said focus f at a point I on control axis 13. This initial position I of focus f corresponds to an initial position PI of rotor 8 along longitudinal axis 7, said initial position PI coinciding in the example of FIG. 2 with the reference position PR.

Thus, a displacement $\Delta_f$ of focus f in one or other direction shown by the first or second arrows 15, 16 bringing it to a position $P_1$ or $P_{1'}$ on control axis 13, determines a variation of the second difference signal SD' applied to the comparator means 72 and a variation of the level of the error signal SE applied to the comparison and control means 70, which by magnetic poles 43 to 46 determine a displacement $\Delta_r$ of the rotor 8 of the same value as the displacement $\Delta_f$ of the focus f, but in the opposite direction. Rotor 8 moves until focus f reassumes its initial position I.

It is pointed out that this operation requires the X-ray tube 3 to produce X-rays. In addition, for maintaining rotor 8 in a fixed position outside an exposure (in which the X-ray exists), it is necessary to supply a signal for replacing that having for its origin the focus position sensing device 14. Thus, in the present embodiment, the X-ray apparatus 1 also has a second power supply 80, which supplies a replacement signal SR. For example, the latter can have a fixed value representing the "cold" position of rotor 8, or can be constituted by a not shown, stored signal of the second difference signal SD', which then represents the position of the focus f at the end of the final exposure.

The switching means 81 receives the replacement signal SR on a first contact element 82, the second difference signal SD' on a second contact element 83 and applies one or other of these signals SD', SR to the negative input of the comparator means 72. The control of the switching means 81 takes place at the start and finish of exposure, as a result of conventional, not shown means.

Figure 3:
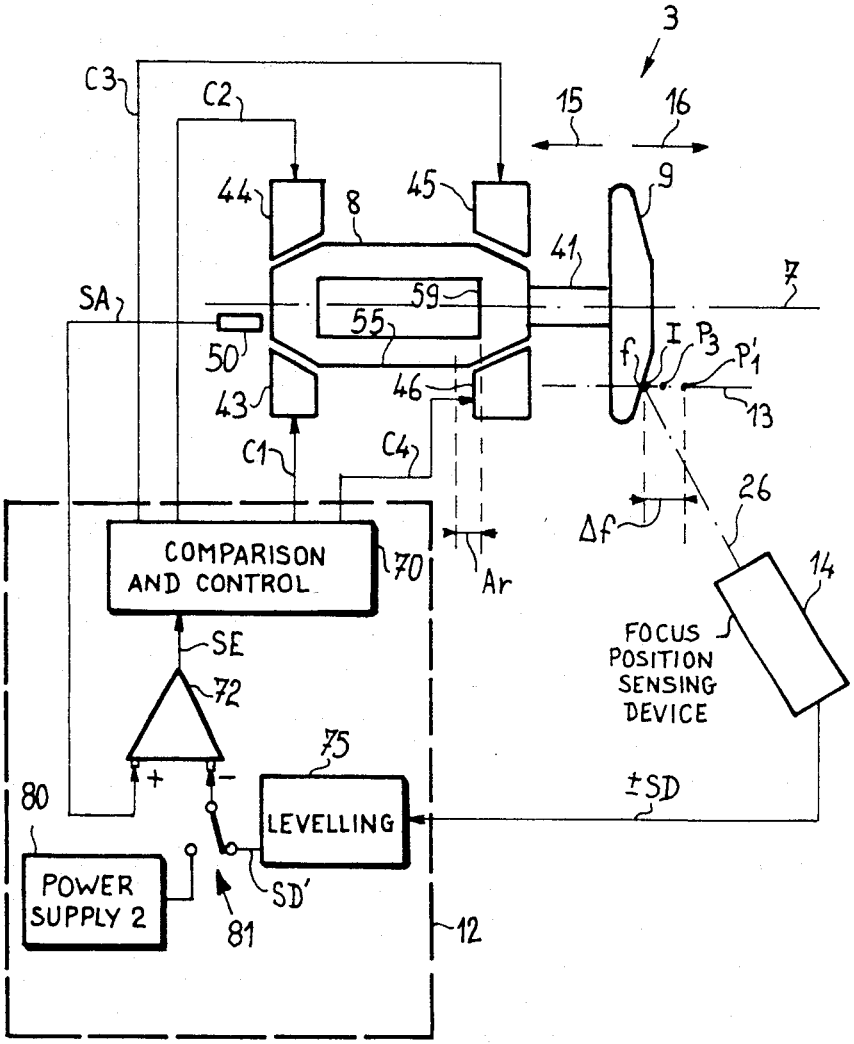
FIG. 3 is a diagram showing the means associated with the magnetic bearings in a second version of the X-ray apparatus according to the invention.

FIG. 3 shows another embodiment of the invention, in which the axial position detector 50 is used. The representation of the X-ray tube 3 is limited to the rotary anode 9, connected to rotor 8 by shaft 41. As in the preceding embodiment, the magnetic poles 43, 44, 45, 46 are controlled by comparison and control means 70.

In this second version of the invention, the axial position detector 50 suppplies an analog signal SA, linked with the position of the rotor 8 along the longitudinal axis 7, said function being the known function of this detector.

The analog signal SA is applied to the positive input of comparator means 72, which receives on its negative input, the second difference signal SD' via switching means 81. As stated hereinbefore, the second difference signal SD' relates to the position of the focus f along the control axis 13.

As in the previous embodiment, the focus position sensing device 14 participates in producing the error signal SE, on the basis of which it produced the action of the magnetic poles 43 to 46 for the positioning of rotor 8 along longitudinal axis 7. However, in the latter configuration, the second difference signal SD' constitutes a variable reference voltage, whereas in the previous configuration, the reference voltage VR was fixed. Under these conditions, the system no longer operates as a comparator relative to a fixed reference voltage, but relative to a reference voltage SD', which varies as a function of the position of focus f along the control axis 13. This situation requires a calibration of the second difference signal SD' with respect to analog control signals $C_1$ to $C_4$ applied to the magnetic poles 43 to 46 for controlling the position of rotor 8. For example, said calibration can consist of reducing or increasing the amplitude of variations $\Delta V_f$ of the second difference signal SD', according to which the latter expresses position variations of focus f along the control axis 13, with respect to the initial position I of focus f.

Thus, apart from maintaining focus f at initial position, I, it is possible to bring about a stabilization of the position of focus f, which consists of reducing a position deviation effect of focus f by undercompensation or overcompensation. Thus, if the variation $\Delta V_f$ of a second difference signal SD', relative to the position variation $\Delta f$ of focus f is equal to $k_f \cdot \Delta_f$, the magnetic bearing system acts on rotor 8 in the direction opposite to the movement of focus f, the movement $\Delta_r$ of rotor 8 being represented by a voltage variation $\Delta V_r$ by the axial position detector 50 equal to:

$$\Delta V_r = k_r \Delta_r$$

kf being a first response coefficient linked with a first measuring channel represented by position sensor 14 and levelling means 75, $k_r$ being a second coefficient linked with the magnetic bearing system, i.e. a second channel represented by axial detector 50, electronic means 12, rotor 8 and magnetic bearing $PM_1$, $PM_2$.

When rotor 8 is returned to position by a value $\Delta_r$, anode 9 carrying focus f is also displaced by a value $\Delta_r$, which produces another variation $\Delta f'$ of the position of focus f represented by another variatiion $\Delta v'f$ of the difference signal SD' equal to:

$$\Delta Vf = kf \cdot \Delta_r$$

Equilibrium will be established when voltages SA and SD' are again equal and therefore:

$$k_r \Delta_r = kf \cdot \Delta f - kf \cdot \Delta_r,$$

or $$\Delta_r (k_r + kf) = \Delta f \cdot kf$$

The relative position variations between rotor 8 and focus f are equal to:

$$\Delta f / \Delta_r = (kf + kr)/(kf), \text{ with } kf >> kr$$

and if these two coefficients are of the same sign + or −, the relationship $k_f/k_r > 1$ and the deviations of focus f are undercompensated. Further, if these two coefficients are of opposite signs then the position variations of the focus are overcome.

It is pointed out that the first coefficient kf is preferably very large compared with the second coefficient kr and in this case the relationship of the position variation $\Delta f$ of focus f with respect to the position variation $\Delta r$ of rotor 8 differs only slightly from 1. The +/− signs allocated to each coefficient kf, $k_r$ can be defined, e.g. at the detector means 17, 18 in sensor 14 and at the inputs of comparator means 72.

In either case, a position variation $\Delta f$ of focus f, which in the second direction 16 is from initial position I to position $P_1'$, is compensated by a displacement $\Delta_r$ of rotor 8 in an opposite direction 15, the displacement $\Delta_r$ or rotor 8 having a value less than or greater than that of displacement $\Delta f$, depending on whether there is overcompensation or undercompensation. In the latter case, focus f is brought into an intermediate position $P_3$ between initial position I and displaced position $P_1'$ on control axis 13.

This description of the X-ray apparatus 1 according to the invention constitutes a non-limitative embodiment, apparatus 1 being able to have, e.g. an X-ray tube 3 equipped with radial or axial magnetic bearings and whose use within the scope of the invention is obvious to the expert.

The X-ray apparatus 1 according to the invention makes it possible to control the position of the focus of a rotary anode of an X-ray tube, along a longitudinal axis of said tube or parallel to said longitudinal axis, by a novel arrangement in which the magnetic bearings of the X-ray tube are combined with a focus position sensing device. The latter can also be of a type different from that described, the essential point being that it participates in producing signals which, in the magnetic bearings, define the axial position of the rotor.

What is claimed is:

1. An X-ray apparatus having focus position control, comprising:

an X-ray tube having:

(a) a rotary anode on which a focus is formed;

(b) a rotor coupled in rotation with the rotary anode for rotating the anode about a longitudinal axis;

(c) magnetic bearings for movably supporting the rotor;

electronic means for controlling the magnetic bearings to move the rotor along the longitudinal axis;

means for sensing the position of the focus for supplying a difference signal to the electronic means, the difference signal corresponding to a position variation of the focus along a control axis parallel to the longitudinal axis;

wherein the difference signal is compared with a reference signal for controlling the magnetic bearings to move the rotor along the longitudinal axis in a direction opposite to the direction in which the position variation of the focus was affected, so as to control and stabilize the position of the focus.

2. An X-ray apparatus according to claim 1, wherein the electronic means comprises:

means for comparing the difference signal and the reference signal to produce an error signal for controlling the magnetic bearings.

3. An X-ray apparatus according to claim 2, wherein the electronic means further comprises:

a power supply for supplying the reference signal; wherein the reference signal is applied to a first input and the difference signal is applied to a second input of the comparing means.

4. An X-ray apparatus according to claim 2, further comprising:

means for axially detecting the position of the rotor along the longitudinal axis and for supplying a signal corresponding to the detected rotor position; wherein the rotor position signal is applied as the reference signal to a first input and the difference signal is applied to a second input of the comparing means.

5. An X-ray apparatus according to claim 4, wherein the focus and the focus position sensing means correspond to a first measuring channel having a first coefficient; and wherein the axial rotor position detecting means, the electronic means, the magnetic bearings and the rotor correspond to a second measuring channel having a second coefficient, the absolute value of the ratio of the first coefficient to the second coefficient exceeding one; and wherein the coefficients are of opposite signs so as to overcome position variation of the focus.

6. An X-ray apparatus according to claim 4, wherein the focus and the focus position sensing means correspond to a first measuring channel having a first coefficient; and wherein the axial rotor position detecting means, the electronic means, the magnetic bearings and the rotor correspond to a second measuring channel having a second coefficient, the ratio of the first coefficient to the second coefficient exceeding one; and wherein the coefficients are of the same sign so as to undercompensate position variations of the focus.

7. An X-ray apparatus according to claim 2, wherein the electronic means comprises:

amplifying means for receiving the difference signal and for applying a levelled difference signal to the comparing means.

8. An X-ray apparatus according to claim 3, wherein the electronic means comprises:

a second power supply for supplying a replacement signal, in place of the difference signal, to the comparing means in the absence of X-rays.

9. An X-ray apparatus according to claim 1, wherein the focus position sensing means comprises:

a pinhole camera; and two contiguous X-ray sensitive detector means, each of the detector means having an input plane on which an image of the focus is produced.

10. An X-ray apparatus according to claim 9, wherein the focus position sensing means further comprises:

means for comparing signals outputted from the two detector means to supply a signal representative of the distribution of the image of the focus over the respective input planes.

11. An X-ray apparatus according to claim 9, wherein the focus position sensing means has a reference axis determined by the pinhole camera and the detector means, the reference axis passing through the focus at a point corresponding to an initial position of the focus.

12. An X-ray apparatus according to claim 1, further comprising:

a member for calibrating the focus position sensing means, the focus position sensing means being coupled to the calibrating member.

* * * * *